US005667926A

United States Patent [19]

Maruyama et al.

[11] Patent Number: 5,667,926

[45] Date of Patent: Sep. 16, 1997

[54] ELECTROPHOTOGRAPHIC APPARATUS AND IMAGE FORMING PROCESS

[75] Inventors: Akio Maruyama, Tokyo; Harumi Sako, Ichikawa; Kazushige Nakamura, Yokohama; Shoji Amamiya, Kawasaki, all of Japan

[73] Assignee: Canon Kabushiki Kaisha, Tokyo, Japan

[21] Appl. No.: 498,874

[22] Filed: Jul. 6, 1995

[30] Foreign Application Priority Data

Jul. 6, 1994 [JP] Japan ..... 6-154683

[51] Int. Cl.[6] ..... G03G 13/06

[52] U.S. Cl. ..... 430/97; 430/66; 430/125; 399/343; 399/347

[58] Field of Search ..... 430/97, 66, 125; 355/211, 296; 399/343, 347

[56] References Cited

U.S. PATENT DOCUMENTS

| | | | |
|---|---|---|---|
| 4,863,823 | 9/1989 | Hiro et al. | 430/66 |
| 4,962,008 | 10/1990 | Kimura et al. | 430/66 |
| 5,043,769 | 8/1991 | Osawa et al. | 355/299 |
| 5,148,639 | 9/1992 | Sakai et al. | 51/328 |
| 5,504,558 | 4/1996 | Ikezue | 430/56 |

FOREIGN PATENT DOCUMENTS

| | | |
|---|---|---|
| 0300426 | 1/1989 | European Pat. Off. . |
| 0312230 | 4/1989 | European Pat. Off. . |
| 0361509 | 4/1990 | European Pat. Off. . |
| 0587067 | 3/1994 | European Pat. Off. . |
| 62-272281 | 11/1987 | Japan . |
| 2167199 | 5/1986 | United Kingdom . |

*Primary Examiner*—Mark Chapman

*Attorney, Agent, or Firm*—Fitzpatrick, Cella, Harper & Scinto

[57] ABSTRACT

An electrophotographic apparatus comprises an electrophotographic photosensitive member, and a charging assembly, an exposure assembly, a development assembly, an image-transfer assembly, and a cleaning assembly arranged around the photosensitive member in this order, wherein the photosensitive member has a surface layer containing fluoroplastic particles; and the electrophotographic apparatus further comprises a polishing assembly for polishing the surface of the photosensitive member after the transfer assembly and before the cleaning assembly.

30 Claims, 1 Drawing Sheet

ELECTROPHOTOGRAPHIC APPARATUS AND IMAGE FORMING PROCESS

BACKGROUND OF THE INVENTION

1. Field of the Invention

The present invention relates to an electrophotographic apparatus, specifically an electrophotographic apparatus containing a specific processing means and a photosensitive member having a specific surface layer, and to an image forming process employing it.

2. Related Background Art

Various methods have been studied to prevent the image staining which occurs when an electrophotographic photosensitive member is repeatedly used. In one attempt, transfer and cleaning of the developer are improved by incorporating fluoroplastic particles resin such as particulate polytetrafluoroethylene into a surface layer of the photosensitive member, reducing the surface energy of the photosensitive member, as shown in Japanese Patent Application Laid-Open No. 62-272281, for example.

To meet the recent demands for the higher durability and higher image quality, however, what is required is an electrophotographic apparatus and an image forming method which can prevent the deterioration of the developer-transferring ability and the developer-cleaning ability which occurs even with the above mentioned method due to the increase of surface energy of the photosensitive member, which can provide superior images.

It was found by the inventors of the present invention that the aforementioned deterioration of the developer transferability and the developer-cleanability during repeated use is caused not only by adhesion of corona discharge by-products or paper powder but also by selective abrasion of fluoroplastic particles of a relatively low hardness from the surface layer of the photosensitive member leaving other resin particles there to result in the rise of the surface energy. The inventors of the present invention studied how to maintain the surface energy state of the surface layer containing the fluoroplastic particles during continuous use of the photosensitive member, and accomplish the objects of the present invention.

SUMMARY OF THE INVENTION

The present invention intends to provide an electrophotographic apparatus which is excellent in developer-transferring ability and developer-cleaning ability and can give high-quality images, and to provide an image forming process employing the electrophotographic apparatus.

The present invention also intends to provide an electrophotographic apparatus which retains high image releasability of the surface of a photosensitive member, and excellent developer-transferability and developer-cleanability of the photosensitive member during repeated use, and gives high-quality images, and to provide an image forming process employing the electrophotographic apparatus.

The electrophotographic apparatus of the present invention comprises an electrophotographic photosensitive member around which a charging means for charging the photosensitive member, a light exposure means for forming an electrostatic latent image by irradiating a light image to the charged photosensitive member, a development means for developing the formed electrostatic latent image, an image-transfer means for transferring the developed image onto an image-receiving means, and a cleaning means for cleaning the surface of the photosensitive member after transferring the developed image are arranged in this order. The photosensitive member has a surface layer containing fluoroplastic particles and the electrophotographic apparatus further contains a polishing means for polishing the surface of the photosensitive member positioned between the transfer means and the cleaning means.

The image forming process of the present.. invention comprises a charging step for charging the photosensitive member, a light exposure step for imagewise-irradiation of the charged photosensitive member to form electrostatic latent image, a development step for developing the formed electrostatic latent image, an image-transfer step for transferring the developed image onto an image-receiving member, and a cleaning step for cleaning the surface of the photosensitive member after transferring the developed image, in this order. The photosensitive member has a surface layer containing fluoroplastic particles and the image forming process further contains a polishing step for polishing the surface of the photosensitive member after the image-transfer step and before the cleaning step.

DESCRIPTION OF THE PREFERRED EMBODIMENTS

Figure 1:
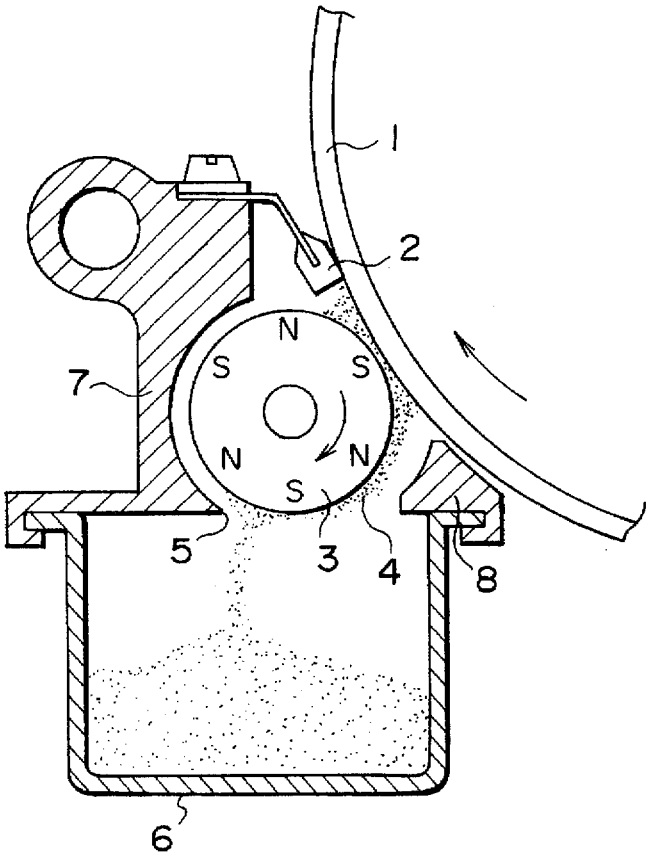
FIG. 1 illustrates schematically an example of the polishing means and the cleaning means of the electrophotographic apparatus of the present invention.

The electrophotographic apparatus of the present invention comprises an electrophotographic photosensitive member having a surface layer containing particles of a fluoroplastic, and a polishing means for polishing the surface of the electrophotographic photosensitive member.

The image forming process of the present invention employs the electrophotographic photosensitive member and the polishing means mentioned above.

The mechanism for the benefit of the present invention is assumed as follows, although it has not been completely elucidated. The particles of a fluoroplastic in the surface layer of the electrophotographic photosensitive member made into a film by the polishing means and the cleaning means during the running of the apparatus coat the electrophotographic photosensitive member, and the coating film keeps the surface energy of the surface of the photosensitive member at a low level to maintain the high developer-transferability and the high developer-cleanability thereof during repeated use. More specifically, when the surface of the photosensitive member is polished by the polishing means, the particles of the fluoroplastic are abraded and the powder attaches to the surface of the photosensitive member making the surface finely rough. The fluoroplastic particles are selectively filmed owing to its low hardness, in a thin film state, to coat the surface of the photosensitive member.

The electrophotographic photosensitive member of the present invention is roughly classified into two types: in one type, a photosensitive layer is provided on an electroconductive support and the surface layer is the photosensitive layer, and in another type, a protection layer is further provided as the surface layer on the photosensitive layer. In both types, the surface layer contains fluoroplastic particles and a binder resin.

The fluoroplastic for the particles includes tetrafluoroethylene resin, trifluorochloroethylene resin, hexafluoropropylene resin, vinyl fluoride resin, vinylidene fluoride resin, difluorodichloroethylene resin, and copolymer resins thereof. The fluoroplastic may be a combination of two or more of the above resins. Of these resins, tetrafluoroethylene resin and vinyl fluoride resin are especially preferred. The average particle diameter of the fluoroplastic particles is preferably not larger than 1 μm, more preferably in the range of from 0.03 to 0.5 μm. When the average particle diameter is larger than 1 μm, uniform coating by the cleaning means tends to become difficult and the transparency of the layer is liable to be excessively lowered, while, when the diameter is less than 0.03 μm, the particles are liable to escape the cleaning means or the coating becomes difficult.

The average particle diameter in the present invention was estimated as follows: A thin-flake sample is cut from the surface layer of the photosensitive member, and observed under a transmission electron microscope (TEM) at a magnification of 200,000x, to measure the major axis of 100 particles randomly selected from those having a diameter larger than 0.01 μm, and the average of the measured length was calculated.

First, the photosensitive member having a protection layer as the surface layer is explained.

The protection layer for the electrophotographic photosensitive member is required typically to have durability against external electrical and mechanical forces, and not to build a residual potential therein accumulating electric charges during repeated use.

Various types of protection layers have been investigated to find one satisfying the above required properties, among which many are resin layers. For example, Japanese Laid-Open Patent Application 57-30846 discloses a protection layer composed of a resin added with an electroconductive particulate metal oxide for controlling the electric resistivity.

The electroconductive particles are dispersed mainly for the purpose of controlling the resistivity of the protection layer and to prevent the increase of residual potential in the photosensitive member by repetition of the electrophotographic process. The volume resistivity of the protection layer ranges preferably from $10^{10}$ to $10^{15}$ Ω.cm.

The protection layer containing the electroconductive particles have high surface energy due to the high surface energy of the electroconductive particles, thereby being inferior to conventional photosensitive member surface in the developer-transferability and the developer-cleanability. Incorporation of fluoroplastic particles as in the present invention greatly improves the developer-transferability and developer-cleanability of the protection layer containing the electroconductive particles.

The coating liquid for the protection layer in the present invention may be prepared by dispersing fluoroplastic particles preferably with a particulate electroconductive material in a resin solution. Into the coating liquid, fluorochemicals such as fluorine type surfactants, fluorine type silane coupling agents, fluorine type silicone oils, and fluorine type graft copolymers may be added to prevent agglomeration of the particles. The added fluorochemical improves remarkably the dispersibility and dispersion stability of the electroconductive particles and the fluoroplastic particles to give a coating liquid of excellent dispersibility. The fluorochemical is added in an amount of preferably from 0.1 to 50% by weight, more preferably from 1 to 30% by weight based on the weight of the fluoroplastic particles.

The examples of preferred fluorine silane coupling agents, fluorine silicone oils, fluorine surfactants, and fluorine graft copolymers are shown below without limiting the compound thereto.

The fluorine silane coupling agent includes the compounds below:

$CF_3\ CH_2\ CH_2\ Si\ (OCH_3)_3$,
$C_4\ F_9\ CH_2\ CH_2\ Si\ (OCH_3)_3$,
$C_6\ F_{13}CH_2\ CH_2\ Si\ (OCH_3)_3$,
$C_8\ F_{17}CH_2\ CH_2\ Si\ (OCH_3)_3$,
$C_8\ F_{17}CH_2\ CH_2\ Si\ (OCH_2\ CH_2OCH_3)_3$,
$C_{10}F_{21}Si\ (OCH_3)_3$,
$C_6\ F_{13}CONH\ Si\ (OCH_3)_3$,
$C_8\ F_{17}CONH\ Si\ (OCH_3)_3$,
$C_7\ F_{15}CONHCH_2\ CH_2\ CH_2\ Si\ (OCH_3)_3$,
$C_7\ F_{15}CONHCH_2\ CH_2\ CH_2\ Si\ (OC_2H_5)_3$,
$C_7\ F_{15}COOCH_2\ CH_2\ CH_2\ Si\ (OCH_3)_3$,
$C_7\ F_{15}COSCH_2\ CH_2\ CH_2\ Si\ (OCH_3)_3$,
$C_8\ F_{17}SO_2\ NHCH_2\ CH_2\ CH_2\ Si\ (OC_2\ H_5)_3$,

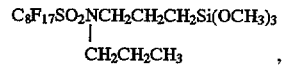

, $C_8\ F_{17}\ CH_2\ CH_2\ SCH_2\ CH_2\ Si\ (OCH_3)_3$,
$C_{10}\ F_{21}\ CH_2\ CH_2\ SCH_2\ CH_2\ Si\ (OCH_3)_3$,

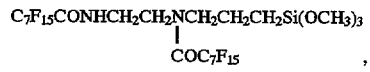

,

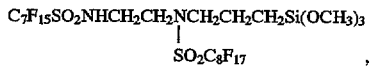

,

The fluorine silicone oil includes:

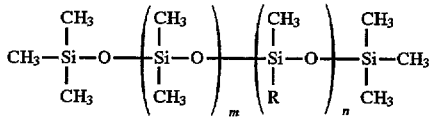

where R represents $—CH_2CH_2CF_3$, and m and n represent independently a positive integer.

The fluorine type surfactant includes:

$X—SO_2\ NRCH_2COOH$,
$X—SO_2\ NRCH_2\ CH_2\ O\ (CH_2\ CH_2\ O)_n\ H$ (n=5, 10, 15),
$X—SO_2\ N\ (CH_2\ CH_2\ CH_2\ OH)_2$,
$X—RO\ (CH_2\ CH_2\ O)\ n$ (n=5, 10, 15),
$X—(RO)_n$ (n=5~20)
$X—(RO)_n\ R$ (n=5~20)

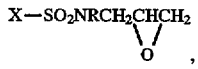

,

X—COOH, $X—CH_2CH_2COOH$
X—ORCOOH,
$X—ORCH_2COOH$, $X—SO_3H$,
$X—ORSO_3H$,
$X—CH_2CH_2OH$,

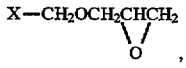

,

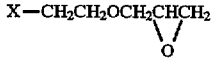

-continued

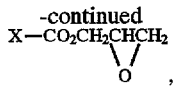

where R is a group of alkyl, aryl, or aralkyl, X is a fluorocarbon group such as $CF_3$, $C_4F_9$, and $C_8F_{17}$.

The fluorine graft polymer includes:

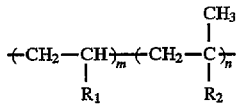

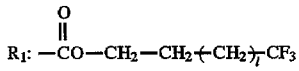

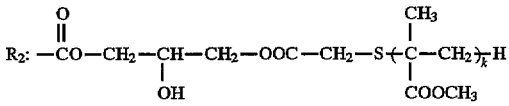

where m, n, l, and k are independently an integer.

The binder resin useful for the protection layer of the present invention includes polycarbonate resins, polyester resins, polyarylate resins, polystyrene resins, polyethylene resins, polypropylene resins, polyurethane resins, acrylic resins, epoxy resins, silicone resins, cellulose resins, polyvinyl chloride resins, phosphazene resins, melamine resins, and vinyl chloride-vinyl acetate copolymer resins. They can be used by itself or in combination of two or more thereof.

Of the above binder resins, curable resins are preferred in view of the surface hardness, abrasion resistance, and dispersibility and dispersion stability of the fine particles. The protection layer, which is satisfactory in view of the dispersibility, hardness, abrasion resistance, and other properties, can be prepared by application of a coating liquid composed of a monomer or oligomer curable by heat or light and dispersed electroconductive particles and fluoroplastic resin particles, onto a photosensitive layer followed by curing.

The above monomer or oligomer curable by heat or light means a molecule having the end of the molecule a functional group polymerizable by heat energy or light energy. The oligomer is a relatively large molecule constituted of from 2 to about 20 repeating units. The polymerizable functional group includes groups having a carbon-carbon double bond such as acryloyl, methacryloyl, and vinyl; silanol groups; groups capable of ring-opening polymerization such as cyclic ethers, and combination of two or more molecules such as phenol-formaldehyde which react each other to polymerize.

The electroconductive particulate material to be added to the protection layer includes particles of metals, metal oxides, and carbon black. The metals includes aluminum, zinc, copper, chromium, nickel, stainless steel, and silver, and plastic particles coated with the above metal by vapor deposition. The metal oxides includes zinc oxide, titanium oxide, tin oxide, antimony oxide, indium oxide, bismuth oxide, indium oxide doped with tin, tin oxide doped with antimony, and zirconium oxide doped with antimony. The above materials may be used singly or in combination of two or more thereof. The combination may be a simple mixture, a solid solution, or fused matter.

The average particle diameter of the electroconductive particulate material is preferably not larger than 0.3 μm, more preferably not larger than 0.1 μm in view of the transparency of the protection layer.

Of the above electroconductive particulate materials, metal oxides are particularly preferred in view of transparency.

The fluoroplastic particles are contained in the protection layer at a content of preferably from 5 to 70% by weight, more preferably from 10 to 60% by weight to the total weight of the protection layer. At the content higher than 70% by weight, the mechanical strength of the protection layer tends to decrease, at the content of lower than 5% by weight, the releasability, abrasion resistance, and scratch resistance of the surface of the protection layer is not satisfactory.

To the protection layer, an additive such as a radical scavenger and an antioxidant may be added to improve further the dispersion, binding property, and weather resistance.

The thickness of the protection layer of the present invention is preferably in the range of from 0.2 to 10 μm, more preferably from 0.5 to 6 μm.

The photosensitive layer in the present photosensitive member is not specially limited, and includes vapor-deposition layers of metals and alloys of Se, Se-Te, Se-As, Se-Sb, and Se-Bi; organic photoconductive layers such as PVK/TNF; amorphous Si layers; dispersions of an inorganic or low-molecular organic photoconductive material in a binder resin, and other known materials.

When an organic photoconductive layer, which is inexpensive but has low mechanical strength, is employed, the protection layer is highly useful for improving the durability and stability.

The photosensitive layer may be a single layer type which contains both the charge-generating substance and the charge-transporting substance in one layer, or may be a lamination type which is formed by laminating a charge-generation layer and a charge transport layer on an electroconductive support. However, the lamination type having a charge-transport layer provided on a charge-generation layer is preferred in consideration of undesirable migration of the components of the protection layer to the photosensitive layer.

Next, the photosensitive member of which surface layer is the photosensitive layer without a protection layer is explained below.

The constitution of the surface layer is not limited, provided that it contains fluoroplastic particles resin. The surface layer may contain both a charge-generating substance and a charge-transporting substance, or the surface layer may be a lamination film constituted of a charge-generation layer and a charge-transport layer formed in this order or the reverse order on an electroconductive supporting member. In the present invention, the lamination film having a charge-generation layer and a charge-transport layer formed thereon is preferred, because the photosensitive characteristics is less affected and the developer-transferability and the developer-cleanability is improved greatly by the addition of the fluoroplastic particles.

A lamination type photosensitive member employing an organic photoconductor is explained as a typical example, although the photosensitive layer is not limited thereto as mentioned above.

The charge-generation layer is formed by applying a coating dispersion of a charge-generating substance in a binder resin, or vacuum-depositing the charge-generating substance. The charge-generating substance includes azo pigments, quinocyanine pigments, perylene pigments, indigo pigments, and phthalocyanine pigments. The binder resin includes polyvinylbutyral, polystyrene, polyvinyl acetate, and acrylic resins. The thickness of the charge-generation layer is preferably not more than 5 μm, more preferably in the range from 0.05 to 3 μm.

The charge-transport layer is formed by applying a coating liquid containing a charge-transporting substance and a film-forming resin. The charge-transporting substance includes pyrazoline compounds, hydrazone compounds, styryl compounds, and triarylamine compounds. The film-forming resin includes polyesters, polycarbonates, polystyrenes, and polymethacrylate esters. The thickness of the charge-transport layer is preferably in the range of from 5 to 40 μm, more preferably from 10 to 30 μm.

The content of the fluoroplastic particles resin is preferably in the range of from 2 to 50% by weight, more preferably from 2 to 30% by weight based on the entire layer to which the fluoroplastic resin is incorporated. At the content thereof higher than 50% by weight, the mechanical strength of the photosensitive layer tends to be lower, and at the content less than 2% by weight, the surface energy is often not sufficiently lowered.

The electroconductive support in the present invention may be made from any material which is electroconductive. The support may be a drum or a sheet made from a metal such as aluminum, copper, chromium, nickel, zinc, and stainless steel; a plastic film laminated with a foil of a metal such as aluminum and copper; a plastic film coated with aluminum, indium oxide, tin oxide and the like by vapor deposition; or a sheet of a metal, a metal alloy, a plastic, or paper having an electroconductive layer formed by application of electroconductive substance singly or in combination with a binder resin.

The cleaning means in the present invention may be a blade, a brush, a roller, or the like. Of these, the blade as the cleaning means which is brought into contact with the surface of the electrophotographic photosensitive member is particularly suitable for removing the remaining developer and for forming a thin film of the fluoroplastic. The material for the blade includes rubbers, plastics, metals, and ceramics. Of these, the elastic rubber blade is superior to other materials in cleaning performance. The elastic rubber material includes urethane rubbers, neoprene rubbers, and silicone rubbers. Of these rubbers, urethane rubbers are particularly suitable in retention of elasticity for a long term.

In order to achieve sufficient cleaning and formation of fluoroplastic film without causing scratches, with combination use of a polishing means described later, the blade is brought into contact with the surface of the photosensitive layer preferably at an angle of from 15° to 45° to the direction counter to the movement direction of the photosensitive member. The contact pressure of the blade is preferably in the range of from 3 to 20 g/cm.

A polishing means is provided, in the present invention, before the above cleaning means and after the transfer means.

The polishing means in the present invention is in contact with the electrophotographic photosensitive member. The polishing means includes brushes and bodies of rubber or sponge. The polishing means may be contacted with the photosensitive member in a fixed state, but it is preferably brought into contact with the photosensitive member with rotation or vibration in consideration of the polishing effect.

The material for the brush as the polishing member includes polymers such as nylon and rayon, and carbon fibers, particularly preferably a magnetic brush formed from a powdery magnetic material on a magnet. The magnetic brush, which has ears formed from a powdery matter, can come in contact with the surface of the photosensitive member in high probability enabling uniform and effective polishing.

The elastic matter such as rubbers and sponges are made preferably in a rotatable roller form to be brought into contact with the photosensitive member. The rubber or sponge as the elastic material has a hardness of preferably not more than 50° of JIS-A type. The rubber material includes EPM, EPDM, norbornene rubber, NBR, chloroprene rubber, natural rubber, isoprene rubber, butadiene rubber, styrene-butadiene rubber, chlorosulfonated polyethylene, hydrin rubber, urethane rubber, SBS, and SEBS. The sponge material includes polystyrenes, polyolefins, polyesters, and polyurethanes. These materials are used in a form of a flexible foam having a low specific gravity. The cell of the foam may contain air, nitrogen, argon, and the like enclosed therein.

The other members for forming the image, including the charging means for charging the photosensitive member, the light exposure means for imagewise exposure of the charged photosensitive member to form electrostatic latent image, the development means for developing the electrostatic latent image, and the transfer means for transferring the developed image onto an image-receiving means, may be of any type, and are not limited specially. The material for the transferred image-receiving member includes paper sheets, and OHP sheets.

FIG. 1 is a side view of an example of the present invention, to explain the cleaning means and a magnetic roller as the polishing means.

Although not shown in the drawing, around the electrophotographic photosensitive member 1, a charging means, an exposure means, a development means, an image-transfer means are arranged.

A cleaning blade 2 is constructed from a blade member such as rubber provided at the tip of the flexible supporting member such as a metal. The cleaning blade 2 is brought into contact with the photosensitive member 1 in a counter direction to the rotation direction (shown by the arrow mark) of the photosensitive member 1 to remove any remaining developer and to coat the photosensitive member with a fluoroplastic.

A magnetic roller 3 as a polishing means is provided, close to the photosensitive member 1, before the cleaning blade 2 and after the image-transfer means. The magnetic roller has magnetic poles along the periphery of the roller and holds magnetic particles 4 in a brush form on the surface thereof, and rotates in the direction shown by the arrow mark. The magnetic brush employed here is formed by attracting the one-component developer composed of magnetic particles which have been removed from the surface of the photosensitive member 1. The magnetic particles are brought into contact with the surface of the photosensitive member 1 while the particles are transported by the magnetic roller 3, whereby the particles polish the surface of the photosensitive member 1.

A non-magnetic scraper 5, which is provided close to, or in contact with the surface of the magnetic roller 3, scrapes the attracted developer from the surface of the magnetic roller 3 downward in the drawing.

A container 6 provided under the scraper 5 stores the scraped developer, and is removable from the main body of the cleaning means. An upper casing 7 having the scraper 5 fixes the cleaning blade 2, and has a guide groove for holding the container 6 at the left end thereof in the drawing. A lower casing 8 has a guide groove for the container 6 the right end thereof in the drawing.

Figure 2:
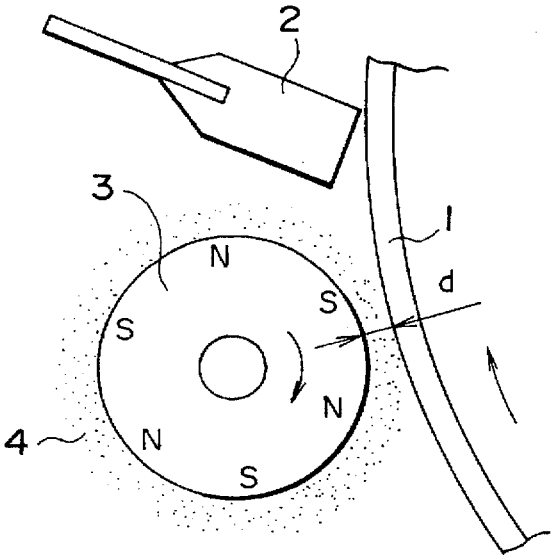
FIG. 2 illustrates schematically another example of the polishing means and the cleaning means of the electrophotographic apparatus of the present invention.

The material for the magnetic particles includes commercial ones such as powdery iron, ferrite, and magnetite. The magnetic brush of the magnetic particles may be formed from the developer as described above. Otherwise, it may be formed from magnetic particles placed preliminarily on the magnet as shown in FIG. 2.

The present invention is described below in more detail by reference to examples and comparative examples. The unit "parts" below is based on weight unless otherwise mentioned.

EXAMPLE 1

On an aluminum cylinder, was applied, by dip coating, a solution of 10 parts of alcohol-soluble polyamide resin (Amylan CM-8000, produced by Toray Industries, Inc.) and 30 parts of methoxymethylated 6-nylon (Toresin EF-30T, produced by Teikoku Kagaku, K. K.) in a mixture of 150 parts of methanol and 150 parts of butanol. The applied matter was dried at 90° C. for 10 minutes to form a subbing layer of 1 μm thick.

Then a dispersion for the charge-generation layer was prepared from 4 parts of the disazo pigment shown by the formula below:

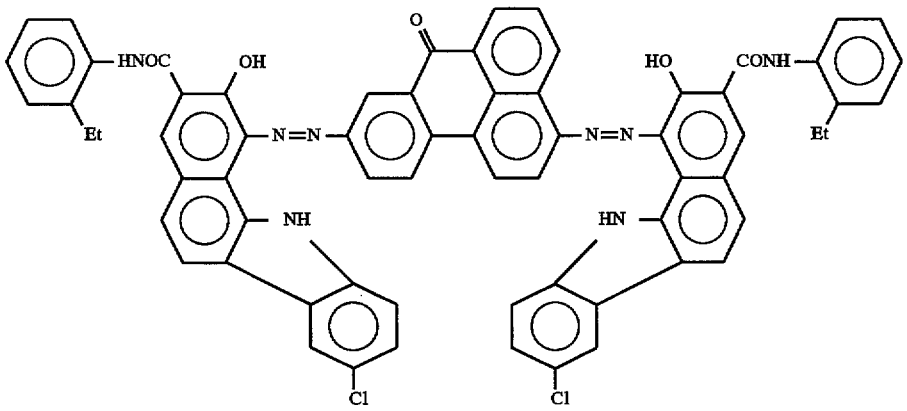

2 parts of a butyral resin (Esurekku BL-S, produced by Sekisui Chemical Co., Ltd.), and 100 parts of cyclohexanone by dispersion treatment with a sand mill for 48 hours, and adding thereto 100 parts of tetrahydrofuran (THF). This dispersion was applied onto the above subbing layer by dip coating, and dried at 80° C. for 15 minutes to form a charge-generation layer of 0.15 μm thick.

A solution for forming a charge-transport layer was prepared by dissolving 10 parts of the triarylamine compound represented by the formula below:

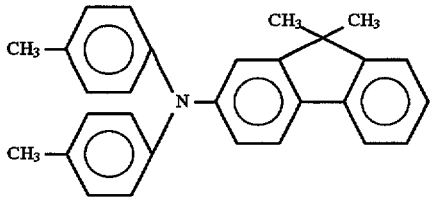

and 10 parts of a polycarbonate resin (Yupiron Z-200, produced by Mitsubishi Gas Chemical Co., Ltd.) in a mixture of 20 parts of dichloromethane and 50 parts of monochlorobenzene. The solution was applied on the above charge-generation layer by dip coating, and dried at 120° C. for 60 minutes to form a charge-generation layer of 20 μm thick.

A liquid dispersion for forming a protection layer was prepared as follows. 25 Parts of a curable acrylic monomer, as the binder resin, represented by the formula below:

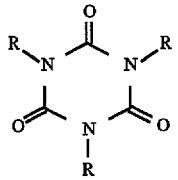

2.0 parts of 2-methylthioxanthone as the photopolymerization initiator, 45 parts of antimony-containing fine particulate tin oxide (T-1, average particle diameter 0.02 μm, produced by Mitsubishi Material Co.) were mixed and dispersed in 300 parts of toluene by means of a sand mill for 72 hours. To the resulting liquid dispersion, 25 parts of a particulate tetrafluoroethylene resin (Lubron L-2, produced by Daikin Industries, Ltd.), and 20 parts of a fluorine silane coupling agent ($C_4F_9CH_2CH_2Si(OCH_3)_3$) are added and treated for dispersion by means of the sand mill for 4 hours. This dispersion for the protection layer was applied by spray coating on the above charge-transport layer, and was dried. After the drying, the applied matter was exposed to ultraviolet light irradiation at an intensity of 800 mW/cm$^2$ for 20 minutes with a high pressure mercury lamp to form a protection layer of 6 μm thick.

The photosensitive member prepared through the above steps was mounted on a digital copying machine (GP-55, manufactured by Canon K. K.) which had been modified as shown in FIG. 1, and was subjected to a running test of 100,000-sheet image formation.

The cleaning blade employed was made of a urethane rubber, and was brought into contact at a contact angle of 30° and at a contact pressure of 5 g/cm.

As the magnetic roller, a magnetite bar was used and rotated in the counter direction to the rotation of the photosensitive member at half of the peripheral speed of the photosensitive member.

The developer employed was a magnetite-containing one-component magnetic toner of 0.2 μm particle diameter.

As the results of the running test, the electrophotographic apparatus caused neither scratches on the surface of the photosensitive member nor insufficient cleaning. During the running test, the transfer efficiency of the developer was always 90% or higher, and satisfactory images were obtained. The transfer efficiency herein is defined by [1 - (amount of developer recovered by cleaner)/(amount of developer consumed from the development means)×100 ].

COMPARATIVE EXAMPLE 1

The image formation running test was conducted in the same manner as in Example 1 except that the magnetic roller was not employed.

As the result, at 25,000-sheet image formation, the urethane rubber blade was reversed towards the rotating direction of the photosensitive member, the cleaning became insufficient, and the surface of the photosensitive member was scratched.

EXAMPLE 2

The subbing layer and the charge-generation layer were prepared in the same manner as in Example 1.

A solution for forming a charge-transport layer was prepared as follows. 10 Parts of the triarylamine represented by the formula below:

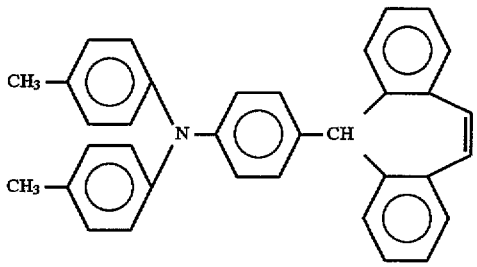

and 10 parts of polycarbonate resin (Yupiron Z-200, produced by Mitsubishi Gas Chemical Co., Ltd.) were dissolved in a mixture of 20 parts of dichloromethane and 50 parts of monochlorobenzene. Separately, 5 parts of particulate tetrafluoroethylene resin (Lubron L-2, produced by Daikin Industries, Ltd.), and 0.1 part of fluorine graft copolymer (GF-300, produced by Daikin Industries, Ltd.) was dispersed in 20 parts of monochlorobenzene for 2 hours by means of a sand mill. The resulting liquid dispersion was mixed with the above solution. The mixture was applied on the above charge-generation layer by dip coating, and dried at 120° C. for 60 minutes to form a charge-transport layer of 20 μm thick.

The obtained photosensitive member was subjected to the image formation running test in the same manner as in Example 1. As the result, at about 80,000 sheets of image formation, image fogging occurred due to the scraping of the surface layer of the photosensitive member. Before that, however, no scratch was formed and cleaning was conducted satisfactorily with the transfer efficiency kept at 90% or higher, forming excellent images during the running test.

COMPARATIVE EXAMPLE 2

The photosensitive member was prepared in the same manner as in Example 2 except that the particulate tetrafluoroethylene resin was not used. Image formation running test was conducted in the same manner as in Example 2 using this photosensitive member.

As the result, at 5,000-sheet image formation, the reversal of the blade was occurred; fogging occurred at 30,000-sheet image formation due to the scraping of the surface layer of the photosensitive member; and at 20,000-sheet image formation and thereafter, image defects appeared due to the scratching of the surface of the photosensitive member.

EXAMPLE 3

A photosensitive member was prepared in the same manner as in Example 1 except that the binder resin for the protection layer was obtained from the curable acrylic monomer represented by the formula below:

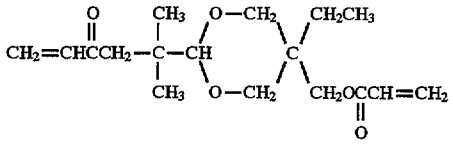

and the fluoroplastic particles were changed to particulate trifluorochloroethylene resin (Daiflon, produced by Daikin Industries, Ltd.).

The obtained photosensitive member was mounted on an electrophotographic apparatus of a color-copying machine (DLC-500, manufactured by Canon K. K.) of reverse development type which is equipped with a semiconductor laser and employs a non-magnetic developer, of which cleaning assembly was modified as shown in FIG. 2.

The obtained photosensitive member was subjected to the running test for 30,000-sheet image formation. The cleaning blade was made of polyurethane rubber. The contact angle of the blade to the photosensitive member was 40°, and the contact pressure was 8 g/cm. The magnetic roller of 15 mm diameter made from magnetite was set at the position 3 in FIG. 2. In FIG. 2, the numeral 1 denotes a photosensitive member; 2, a cleaning blade; 3, a magnetic roller; and 4, a magnetic particles. In this Example, the magnetic particles were ferrite powder of an average particle diameter of 20 μm.

As the result, until 30,000-sheet image formation, no image defect occurred which could be caused by scratch on the photosensitive member or insufficient cleaning. The transfer efficiency was kept invariably at 87% or higher.

COMPARATIVE EXAMPLE 3

The image formation running test was conducted in the same manner as in Example 3 except that the magnetic roller was not employed.

As the result, at 2,000-sheet image formation, the blade was reversed toward the rotation direction of the photosensitive member, the cleaning became insufficient, and efficiency of the developer transfer during the running test was not higher then 80%.

What is claimed is:

1. An electrophotographic apparatus comprising an electrophotographic photosensitive member, and a charging means for charging the photosensitive member, an exposure means for irradiating imagewise the charged photosensitive member to form an electrostatic latent image, a development means for developing the formed electrostatic latent image, an image-transfer means for transferring the developed image onto an image-receiving means, and a cleaning means for cleaning the surface of the photosensitive member after transferring the developed image arranged around the photosensitive member in this order;

the photosensitive member having a surface layer containing fluoroplastic particles; and the electrophotographic apparatus further comprising a polishing means for polishing the surface of the photosensitive member after the transfer means and before the cleaning means.

2. An electrophotographic apparatus according to claim 1, wherein the surface layer further contains a binder resin.

3. An electrophotographic apparatus according to claim 1 or 2, wherein the fluoroplastic particles are composed of at least one resin selected from the group consisting of tetrafluoroethylene resin, difluorochloroethylene resin, hexafluoropropylene resin, vinyl fluoride resin, vinylidene fluoride resin, and difluorodichloroethylene resin.

4. An electrophotographic apparatus according to claim 3, wherein the fluoroplastic particles are composed of at least one resin selected from tetrafluoroethylene resin, and vinylidene fluoride resin.

5. An electrophotographic apparatus according to claim 1, wherein the fluoroplastic particles have an average particle diameter of not larger than 1 μm.

6. An electrophotographic apparatus according to claim 5, wherein the fluoroplastic particles have an average particle diameter ranging from 0.03 to 0.5 μm.

7. An electrophotographic apparatus according to claim 1 or 2, wherein the electrophotographic photosensitive member has a protection layer as the surface layer.

8. An electrophotographic apparatus according to claim 7, wherein the protection layer contains a particulate electroconductive material.

9. An electrophotographic apparatus according to claim 1 or 2, wherein the electrophotographic photosensitive member has a photosensitive layer, and the photosensitive layer is the surface layer.

10. An electrophotographic apparatus according to claim 1, wherein the cleaning means comprises a cleaning blade.

11. An electrophotographic apparatus according to claim 10, wherein the blade is an elastic rubber blade.

12. An electrophotographic apparatus according to claim 11, wherein the elastic rubber contains urethane rubber.

13. An electrophotographic apparatus according to claim 10, wherein the blade is brought into contact with the photosensitive member at an angle ranging from 15° to 45° counter to the moving direction of the photosensitive member.

14. An electrophotographic apparatus according to claim 10 or 13, wherein the blade is brought into contact with the photosensitive member at a contact pressure ranging from 3 to 20 g/cm.

15. An electrophotographic apparatus according to claim 1, wherein the polishing means comprises a magnetic brush.

16. An image forming process comprising a charging step for charging the photosensitive member, an exposure step for irradiating the electrified photosensitive member to form an electrostatic latent image, a development step for developing the formed electrostatic latent image, an image-transfer step for transferring the developed image onto an image-receiving member, and a cleaning step for cleaning the surface of the photosensitive member after transferring the developed image, the steps being conducted in this order:

the photosensitive member having a surface layer containing fluoroplastic particles; and the image forming process further comprising a polishing step for polishing the surface of the photosensitive member after the image-transfer step and before the cleaning step.

17. An image forming process according to claim 16, wherein the surface layer further contains a binder resin.

18. An image forming process according to claim 16 or 17, wherein the fluoroplastic particles are composed of at least one resin selected from the group consisting of tetrafluoroethylene resin, difluorochloroethylene resin, hexafluoropropylene resin, vinyl fluoride resin, vinylidene fluoride resin, and difluorodichloroethylene resin.

19. An image forming process according to claim 18, wherein the fluoroplastic particles are composed of at least one resin selected from tetrafluoroethylene resin, and vinylidene fluoride resin.

20. An image forming process according to claim 16, wherein the fluoroplastic particles have an average particle diameter of not larger than 1 μm.

21. An image forming process according to claim 20, wherein the fluoroplastic particles have an average particle diameter ranging from 0.03 to 0.5 μm.

22. An image forming process according to claim 16 or 17, wherein the electrophotographic photosensitive member has a protection layer as the surface layer.

23. An image forming process according to claim 22, wherein the protection layer contains a particulate electroconductive material.

24. An image forming process according to claim 16 or 17, wherein the electrophotographic photosensitive member has a photosensitive layer, and the photosensitive layer is the surface layer.

25. An image forming process according to claim 16, wherein the cleaning step is conducted with a cleaning blade.

26. An image forming process according to claim 25, wherein the blade is an elastic rubber blade.

27. An image forming process according to claim 26, wherein the elastic rubber contains urethane rubber.

28. An image forming process according to claim 25, wherein the blade is brought into contact with the photosensitive member at an angle ranging from 15° to 45° counter to the moving direction of the photosensitive member.

29. An image forming process to claim 25 or 28, wherein the blade is brought into contact with the photosensitive member at a contact pressure ranging from 3 to 20 g/cm.

30. An image forming process according to claim 16, wherein the polishing step is conducted with a magnetic brush.

* * * * *

UNITED STATES PATENT AND TRADEMARK OFFICE

CERTIFICATE OF CORRECTION

PATENT NO. : 5,667,926

DATED : September 16, 1997

INVENTOR(S) : AKIO MARUYAMA ET AL.

It is certified that error appears in the above-identified patent and that said Letters Patent is hereby corrected as shown below:

COLUMN 1

Line 27, "above mentioned" should read --above-mentioned--.
Line 29, "which" should read --and which--.
Line 31, "developer transfer-" should read --developer-transfer---.

COLUMN 2

Line 7, "present.." should read --present--.
Line 10, "electrostatic" should read --an electrostatic--.

COLUMN 10

Line 2, "25 Parts" should read --25 parts--.
Line 11, Insert: --R:-$CH_2CH_2OCOCH=CH_2$--.

COLUMN 11

Line 15, "10 Parts" should read --10 parts--.
Line 59, "was" should be deleted.

COLUMN 12

Line 26, "a" (third occurrence) should be deleted.
Line 43, "then" should read --than--.

UNITED STATES PATENT AND TRADEMARK OFFICE

CERTIFICATE OF CORRECTION

PATENT NO. : 5,667,926

DATED : September 16, 1997

INVENTOR(S) : AKIO MARUYAMA ET AL.

It is certified that error appears in the above-identified patent and that said Letters Patent is hereby corrected as shown below:

COLUMN 14

Line 44, "process" should read --process according--.

Signed and Sealed this

Seventeenth Day of March, 1998

*Attest:*

Bruce Lehman

BRUCE LEHMAN

*Attesting Officer*

*Commissioner of Patents and Trademarks*